US006251573B1

(12) United States Patent
Tappe et al.

(10) Patent No.: US 6,251,573 B1
(45) Date of Patent: Jun. 26, 2001

(54) COLOR PHOTOGRAPHIC DEVELOPER CONCENTRATE

(75) Inventors: Gustav Tappe; Wolfgang Körner, both of Leverkusen (DE)

(73) Assignee: Agfa-Gevaert (BE)

( * ) Notice: Subject to any disclaimer, the term of this patent is extended or adjusted under 35 U.S.C. 154(b) by 0 days.

(21) Appl. No.: 09/545,376

(22) Filed: Apr. 7, 2000

(30) Foreign Application Priority Data

| | | |
|---|---|---|
| Apr. 15, 1999 | (DE) | 199 16 933 |
| Jun. 17, 1999 | (DE) | 199 27 605 |
| Dec. 21, 1999 | (DE) | 199 61 601 |

(51) Int. Cl.[7] ..... G03C 7/413
(52) U.S. Cl. ..... 430/466
(58) Field of Search ..... 430/466

(56) References Cited

U.S. PATENT DOCUMENTS 5,891,609 4/1999 Papai ..... 430/466

OTHER PUBLICATIONS

Research Disclosure 37038, Feb. 1995, pp. 102–107.

*Primary Examiner*—Hoa Van Le
(74) *Attorney, Agent, or Firm*—Connolly Bove Lodge & Hutz LLP

(57) ABSTRACT

A one-part color developer concentrate which comprises at least two phases and which is free from precipitates at 20° C., which contains at least one color developer substance, at least one antioxidant, at least one anti-lime agent, a buffer system and alkali, one phase of which is aqueous and the other phase of which is organic, wherein the aqueous phase has a pH of at least 9, is obtained when the concentrate has a concentration of cations from 0.5 to 15 mol/l, wherein at least 10 mol % of the cations are sodium ions and the organic phase is formed from one or more water-soluble solvents, and wherein 50 to 95% by weight of the sum of water and water-soluble solvents is water.

8 Claims, No Drawings

COLOR PHOTOGRAPHIC DEVELOPER CONCENTRATE

The developer solution which is used for the development of colour photographic materials, particularly for the development of colour photographic paper, is made up from or is regenerated in continuous operation by concentrates which contain the necessary constituents.

It is customary to provide three different concentrates, since certain constituents of the developer bath are incompatible with each other on storage for an extended period. Thus, for example, one concentrate may contain the antioxidant, an auxiliary solvent and an optical brightener, a second concentrate may contain the colour developer substance, e.g. CD 3 4-(N-ethyl-N-2-methylsulphonylaminoethyl)-2-methyl-phenylenediamine sequisulphate and a third concentrate may contain the buffer substance, alkali and an anti-lime agent.

There has been no lack of attempts aimed at developing stable, one-part colour developer concentrates, since errors in handling, making up or regenerating a developer solution could thereby be avoided.

Currently, there are two one-part concentrates on the market: a) Monoline® RA-4 CD-R manufactured by Tetenal, a two-phase concentrate with an undissolved, solid phase lying on the bottom, and b) Tri Phase® RA-4 CD-R manufactured by Trebla, a three-phase concentrate with undissolved constituents in the middle phase (see U.S. Pat. No. 5,891,609 also).

In both these cases, the presence of undissolved constituents constitutes a disadvantage with regard to the handling of the concentrates. Problems can arise in particular when making up the regenerator solution, because the undissolved constituents can only be dissolved with difficulty.

The object of the present invention was to provide a one-part concentrate for a colour developer which contains no undissolved constituents and from which a regenerator solution can be prepared rapidly.

This object is achieved in that apart from the customary chemicals which are necessary for the development of a colour photographic material the concentrate contains a minimum amount of one or more water-soluble auxiliary solvents and a minimum amount of sodium ions, both in absolute terms and in relation to the other cations.

A concentrate in the sense of the invention is an aqueous preparation, one part by volume of which is diluted with 1 to 39 parts by volume of water in order to prepare a ready-to-use solution; the concentrate contains at least 50 mmol, preferably 70 to 700 mmol, of colour developer substance per liter.

The present invention therefore relates to a one-part colour developer concentrate which contains at least one colour developer substance, at least one antioxidant, at least one anti-lime agent, a buffer system and alkali, has a ph of at least 9 and a concentration of cations from 0.5 to 15 mol/l, wherein at least 10 mol %, preferably at least 30 mol %, most preferably at least 50 mol % of the cations arc sodium ions and contains at least 50 mmol colour developer substance per liter.

The concentrate comprises one phase or more than one phase, preferably two phases. At least one phase is an organic phase and one is an aqueous phase, the organic phase containing one or more w,water-soluble organic solvents wherein 50 to 95 %, preferably 60 to 90 %, by weight of the sum of organic solvents and water are water.

Examples of suitable water-soluble solvents include derivatives of carboxylic acid amides and derivatives of urea, such as dimethylformamide, methylacetamide, di-methylacetamide, N,N'-climethylurea, tetramethylurea, methanesulphonic acid amide, dimethylethyleneurea, N-acetylglycine, N-valeramide, isovaleramide, N-butyramide, N,N-dimethylbutyramide, N-(2-hydroxyphenyl)-acetamide, N-(2-methoxyphenyl)-acetamide, 2-pyrrolidinone, ϵ-caprolactam, acetanilide, benzamide, toluenesulphonic acid amide, phthalimide;

aliphatic and cyclic alcohols, e.g. isopropanol, tert.-butyl alcohol, cyclohexanol, cyclohexanemethanol, 1,4-cyclohexanedimethanol;

aliphatic and cyclic polyalcohols, e.g. glycols, polyglycols, polymer waxes, trimethyl-1,6-hexanediol, glycerol, 1,1,1-trimethylolpropane, pentaerythritol, sorbitol;

aliphatic and cyclic ketones, e.g. acetone, methyl ethyl ketone, diethyl ketone, tert.-butyl methyl ketone, diisobutyl ketone, acetylacetone, acetonylacetone, cyclopentanone, acetophenone;

aliphatic and cyclic carboxylic acid esters, e.g. triethoxymethane, metlhyl acetate, allyl acetate, methyl glycol acetate, ethylene glycol diacetate, glycerol-1 acetate, glycerol diacetate, methylcyclohexyl acetate, methyl salicylate, phenyl salicylate;

aliphatic and cyclic phosphonic acid esters, e.g. methylphosphonic acid dimethyl ester, allylphosphonic acid diethyl ester;

aliphatic and cyclic oxy alcohols, e.g. 4-hydroxy-4-methyl-2-pentanone, salicylaldehyde;

aliphatic and cyclic aldehydes, e.g. acetaldehyde, propanal, trimethylacetaldehyde, crotonaldehyde, glutaraldehyde, 1,2,5,6-tetrahydrobenzaldehyde, benzaldehyde, benzenepropanal, terephthalaldehyde;

aliphatic and cyclic oximes, e.g. butanone oxime, cyclohexanone oxime;

aliphatic and cyclic amines (primary, secondary or tertiary) e.g. ethylamine, di-ethylamine, triethylamine, dipropylamine, pyrrolidine, morpholine, 2-aminopyrimidine;

aliphatic and cyclic polyamines (primary, secondary or tertiary), e.g. ethylenediamine, 1-amino-2-dimethylaminoethane, methyl-bis-(2-methylamino-ethyl)amine, permethyl-diethylenetriamine, 1,4-cyclohexanediamine, 1,4-benzenediamine;

aliphatic and cyclic hydroxyamines, e.g. ethanolamine, 2-methylethylamine, 2-methylaminoethanol, 2-(dimethylamino)ethanol, 2-(2-dimethylamino-ethoxy)-ethanol, diethanolamine, N-methyldiethanolamine, triethanolamine, 2-(2-amninoethyl-amino)-ethanol, triisopropanolamine, 2-amino-2-hydroxymethyl-1,3-propanediol, 1-piperidinoethanol, 2-aminophenol, barbituric acid, 2-(4-aminophenoxy)-ethanol, 5-amino-1-naphthol.

Good phase separation is achieved with the aforementioned solvents, either individually or in admixture.

Processing conditions, suitable colour developer substances, suitable buffer substances, suitable anti-lime agents, suitable optical brighteners, auxiliary developers, wetting agents, crosslinking agents, development accelerators and anti-fogging agents are described in Research Disclosure 37 038 (February 1995) on pages 102 to 107.

4-(N-ethyl-N-2-methylsulphonylaminoethyl)-2-methyl-phenylenediamine sesquisulphate (CD-3) and 4-(N-Ethyl-N-2-hydroxyethyl)-2-methyl-phenylenediamine sulfate (CD-4) are preferred as the colour developing substances.

Suitable antioxidants are compounds of formulae (I), (II) and (III)

(I)

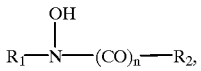

wherein $R_1$ denotes unsubstituted or substituted alkyl, $R_2$ denotes unsubstituted or substituted alkyl or aryl, and n denotes 0 or 1, preferably those in which at least one of the $R_1$ and $R_2$ radicals contains at least one —OH, —COOH or —$SO_3H$ group;

(II)

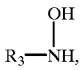

wherein $R_3$ denotes an alkyl or acyl group;

(III)

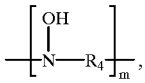

wherein $R_4$ denotes an alkylene group which is optionally interrupted by O atoms, and m denotes a number of at least 2.

The alkyl groups $R_1$, $R_2$, $R_3$, the alkylene group $R_4$ and the aryl group $R_2$ can comprise further substituents in addition to the aforementioned substituents.

Examples of suitable antioxidants include:

(0-1)

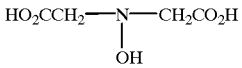

(0-2)

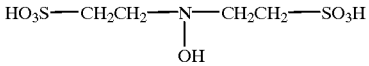

(0-3)

$CH_3CH(CH_3)NHOH$ (0-4)

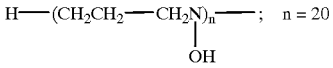

(0-5)

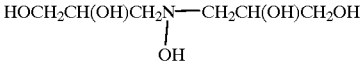

(0-6)

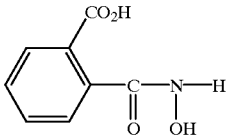

-continued (0-7)

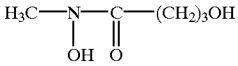

(0-8)

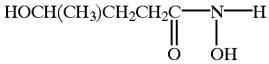

(0-9)

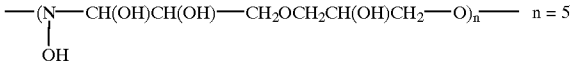

(0-10)

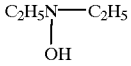

When the concentrate is diluted with water in order to prepare the ready-to-use colour developer or regenerator, the phase boundaries disappear; the ready-to-use developer is monophase.

EXAMPLES

EXAMPLE 1

Comparison

The usual constituents of a colour developer regenerator were mixed together in a concentrate (the ready-to-use regenerator was prepared from the concentrate by dilution with water):

| One-part developer concentrate: | |
|---|---|
| diethylhydroxylamine, 85% by weight aqueous solution (DEHX sln.) | 60 ml |
| CD3 | 70 g |
| caprolactam | 100 g |
| triethanolamine | 80 ml |
| optical brightener | 10 g |
| ethylenediaminetetraacetic acid (EDTA) | 30 g |
| potassium carbonate | 300 g |
| potassium hydroxide | 30 g |
| made up to 1 liter with water. | |

The cation concentration ($Na^+$, $K^+$) amounted to 4.9 mol/l, of which 0 mol % was $Na^{30}$ ions.

The concentrate formed 3 phases, the middle phase contained undissolved constituents.

EXAMPLE 2

Comparison

| One-part developer concentrate: | |
|---|---|
| DEHX sln. | 60 ml |
| CD3 | 70 g |
| p-toluenesulphonic acid | 100 g |
| diethylene glycol | 80 ml |
| optical brightener | 10 g |
| EDTA | 30 g |

-continued

| One-part developer concentrate: | |
|---|---|
| potassium carbonate | 300 g |
| potassium hydroxide | 30 g |
| made up to 1 liter with water. | |

The cation concentration ($N^+$, $K^+$) amounted to 4.9 mol/l, of which 0 mol % was $Na^+$ ions.

Despite the auxiliary solvents, the concentrate formed 3 phases, and the middle phase contained undissolved constituents.

EXAMPLE 3

Comparison

| One-part developer concentrate: | |
|---|---|
| DEHX sln. | 60 ml |
| CD3 | 70 g |
| caprolactam | 100 g |
| triethanolamine | 80 ml |
| optical brightener | 10 g |
| EDTA | 30 g |
| potassium carbonate | 200 g |
| potassium hydroxide | 30 g |
| made up to 1 liter with water. | |

The cation concentration ($Na^+$, $K^+$) amounted to 3.4 mol/l, of which 0 mol % was $Na^+$ ions.

Even with less potassium carbonate, the concentrate formed 3 phases, and the middle phase contained undissolved constituents.

EXAMPLE 4

Comparison

| One-part developer concentrate: | |
|---|---|
| DEHX sln. | 60 ml |
| CD3 | 70 g |
| caprolactam | 100 g |
| diethylene glycol | 80 ml |
| optical brightener | 10 g |
| EDTA | 30 g |
| potassium carbonate | 300 g |
| potassium hydroxide | 23 g |
| sodium hydroxide | 7 g |
| made up to 1 liter with water. | |

The cation concentration ($Na^+$, $K^+$) amounted to 5.1 mol/l, of which 5 mol % was $Na^+$ ions.

Even with a cation content corresponding to 15 mol % sodium, the concentrate formed 3 phases, and the middle phase contained undissolved constituents.

EXAMPLE 5

According to the Invention

| One-part developer concentrate: | |
|---|---|
| DEHX sln. | 60 ml |
| CD3 | 70 g |
| caprolactam | 100 g |
| diethylene glycol | 80 ml |
| optical brightener | 10 g |
| EDTA | 30 g |
| potassium carbonate | 140 g |
| sodium carbonate | 18 g |
| sodium hydroxide | 30 g |
| made up to 1 liter with water. | |

The cation concentration ($Na^+$, $K^+$) amounted to 3.1 mol/l, of which 35 mol % was $Na^+$ ions. The pH of the aqueous phase was 11.

With a cation content corresponding to 35 mol % sodium, the concentrate formed 2 phases; both phases were completely dissolved and well separated from each other.

EXAMPLE 6

According to the Invention

| One-part developer concentrate: | |
|---|---|
| DEHX sln. | 60 ml |
| CD3 | 70 g |
| polymer wax 1550 (polyethylene glycol with a molecular weight of 1550) | 100 g |
| diethylene glycol | 80 ml |
| optical brightener | 10 g |
| EDTA | 30 g |
| potassium carbonate | 100 g |
| sodium carbonate | 50 g |
| sodium hydroxide | 30 g |
| made up to 1 liter with water. | |

The cation concentration ($Na^+$, $K^+$) amounted to 3.1 mol/l, of which 54 mol % was $Na^+$ ions. The pH of the aqueous phase was 11.

With a cation content corresponding to 54 mol % sodium, the concentrate formed 2 phases; both phases were completely dissolved and well separated from each other.

EXAMPLE 7

According to the Invention

| One-part developer concentrate: | |
|---|---|
| disulphoethylhydroxylamine (HADS) | 50 g |
| CD3 | 70 g |
| glycerol | 100 g |
| triethanolamine | 80 ml |
| optical brightener | 10 g |
| EDTA | 30 g |
| sodium carbonate | 130 g |
| sodium hydroxide | 30 g |
| made up to 1 liter with water. | |

The cation concentration ($Na^+$, $K^+$) amounted to 3.2 mol/l, of which 100 mol % was $Na^+$ ions. The pH of the aqueous phase was 11.

With a cation content corresponding to 100 mol % sodium, the concentrate formed 2 phases; both phases were completely dissolved and well separated from each other.

EXAMPLE 8

According to the Invention

One-part developer concentrate:

The following concentrate constituents were added to water in succession:

| | |
|---|---|
| sodium hydroxide | 30 g |
| optical brightener | 10 g |
| sodium carbonate | 100 g |
| DEHX solution | 80 ml |
| triethanolamine | 80 g |
| CD3 | 70 g |
| dimethylacetamide | 120 g |
| EDTA | 30 g |
| potash | 30 g |
| made up to 1 liter with water. | |

The cation concentration ($Na^+$, $K^+$) amounted to 3.1 mol/l, of which 86 mol % was $Na^+$ ions.

With a cation content corresponding to 86 mol % sodium, the concentrate formed 2 phases; both phases were completely dissolved and well separated from each other.

EXAMPLE 9

According to the Invention

The following concentrate constituents were added to water in succession:

| | |
|---|---|
| sodium hydroxide | 30 g |
| optical brightener | 10 g |
| sodium carbonate | 100 g |
| DEHX solution | 80 ml |
| HADS | 65 g |
| polyethlene glycol, mol wt. 400 | 80 ml |
| CD3 | 70 g |
| dimethylacetamide | 120 g |
| EDTA | 30 g |
| potash | 30 g |
| made up to 1 liter with water. | |

The cation concentration ($Na^+$, $K^+$) amounted to 3.1 mol/l, of which 86 mol % was $Na^+$ ions.

With a cation content corresponding to 86 mol % sodium, the concentrate formed 2 phases; both phases were completely dissolved and well separated from each other.

EXAMPLE 10

According to the Invention

The following concentrate constituents were added to water in succession:

| | |
|---|---|
| sodium hydroxide | 30 g |
| optical brightener | 10 g |
| sodium carbonate | 100 g |
| DEHX solution | 80 ml |

-continued

| | |
|---|---|
| HADS | 65 g |
| CD3 | 70 g |
| caprolactam | 120 g |
| EDTA | 30 g |
| potash | 30 g |
| made up to 1 liter with water. | |

The cation concentration ($Na^+$, $K^+$) amounted to 3.1 mol/l, of which 86 mol % was $Na^+$ ions.

With a cation content corresponding to 86 mol % sodium, the concentrate formed 2 phases; both phases were completely dissolved and well separated from each other The one-part concentrates according to the invention were stable and resulted in a sensitometry corresponding to this type of product when employed for the processing of a colour paper under standard conditions.

EXAMPLE 11

The usual constituents of a colour developer regenerator were mixed together in a concentrate (the ready-to-use regenerator was prepared from the concentrate by dilution with water):

One-part, one-phase developer concentrate:

| | |
|---|---|
| DEHX solution | 35 ml |
| CD 3 | 50 g |
| diethylene glycol | 30 ml |
| optical brightener | 2 g |
| EDTA | 10 g |
| potassium carbonate | 60 g |
| pH adjusted with KOH to 13.5 | |
| made up to 1 liter with water. | |

Precipitation of ingredients occurs at 20° C.

EXAMPLE 12

Comparison

One-part, one-phase developer concentrate:

| | |
|---|---|
| HADS | 35 g |
| CD 3 | 50 g |
| diethylene glycol | 30 ml |
| optical brightener | 2 g |
| EDTA | 10 g |
| potassium carbonate | 60 g |
| pH adjusted with KOH to 13.5 | |
| made up to 1 liter with water. | |

Precipitation of ingredients occurs at 20° C.

EXAMPLE 13

According to the Invention

One-part, one-phase developer concentrate:

| | |
|---|---|
| DEHX solution | 35 ml |
| CD 3 | 50 g |
| diethylene glycol | 30 ml |

-continued

| | |
|---|---|
| optical brightener | 2 g |
| EDTA | 10 g |
| sodium carbonate | 60 g |
| pH adjusted to 13.5 with NaOH | |
| made up to 1 liter with water. | |

No precipitation occurs at 20° C.

EXAMPLE 14

According to the Invention

One-part, one-phase developer concentrate:

| | |
|---|---|
| HADS | 35 g |
| CD3 | 50 g |
| diethylene glycol | 30 ml |
| optical brightener | 2 g |
| EDTA | 10 g |
| sodium carbonate | 60 g |
| pH adjusted to 13.5 with NaOH | |
| made up to 1 liter with water. | |

No precipitation occurs at 20° C.

EXAMPLE 15

Comparison

One-part, one-phase developer concentrate:

| | |
|---|---|
| potassium disulphite | 40 g |
| CD4 | 60 g |
| hydroxylammonium sulphate | 30 g |
| potassium carbonate | 40 g |
| EDTA | 20 g |
| potassium bromide | 5 g |
| pH adjusted to 10.6 with KOH | |
| made up to 1 liter with water. | |

Precipitation of ingredients occurs at 20° C.

EXAMPLE 16

Comparison

One-part, one-phase developer concentrate:

| | |
|---|---|
| HADS | 75 g |
| CD4 | 60 g |
| potassium carbonate | 40 g |
| EDTA | 20 g |
| potassium bromide | 5 g |
| pH adjusted to 10.6 with KOH | |
| made up to 1 liter with water. | |

Precipitation of ingredients occurs at 20° C.

EXAMPLE 17

According to the Invention

| | |
|---|---|
| sodium disulphite | 36 g |
| CD4 | 60 g |
| hydroxylammonium sulphate | 30 g |
| sodium carbonate | 31 g |
| EDTA | 20 g |
| sodium bromide | 4.3 g |
| pH adjusted to 10.6 with NaOH | |
| made up to 1 liter with water. | |

No precipitation occurs at 20° C.

EXAMPLE 18

According to the Invention

One-part, one-phase developer concentrate:

| | |
|---|---|
| HADS | 75 g |
| CD4 | 60 g |
| sodium carbonate | 31 g |
| EDTA | 20 g |
| sodium bromide | 4.3 g |
| pH adjusted to 10.6 with NaOH | |
| made up to 1 liter with water. | |

No precipitation occurs at 20° C.

EXAMPLE 19

Comparison

One-part, two-phase developer concentrate:

| | |
|---|---|
| HADS | 75 g |
| CD4 | 60 g |
| caprolactame | 160 g |
| potassium carbonate | 40 g |
| EDTA | 20 g |
| potassium bromide | 5 g |
| pH adjusted to 10.6 with KOH | |
| made up to 1 liter with water. | |

Precipitation of ingredients occurs at 20° C.

EXAMPLE 20

According to the Invention

One-part, two-phase developer concentrate:

| | |
|---|---|
| HADS | 75 g |
| CD4 | 60 g |
| caprolactame | 160 g |
| sodium carbonate | 31 g |
| EDTA | 20 g |
| sodium bromide | 4.3 g |
| pH adjusted to 10.6 with NaOH | |
| made up to 1 liter with water. | |

No precipitation occurs at 20° C.

EXAMPLE 21

According to the Invention

One-part, two-phase developer concentrate:

| | |
|---|---|
| HADS | 75 g |
| CD4 | 60 g |
| polyethylene glycol, molecular weight 400 | 250 ml |
| sodium carbonate | 31 g |
| EDTA | 20 g |
| sodium bromide | 4.3 g |
| pH adjusted to 10.6 with NaOH | |
| made up to 1 liter with water. | |

No precipitation occurs at 20° C.

EXAMPLE 22

A colour photographic recording material was produced by depositing the following layers in the given sequence on a film base comprising paper coated on both sides with polyethylene. The quantitative data are given with respect to 1 $m^2$ in each case. The corresponding amounts of $AgNO_3$ are quoted for silver halide deposition.

Layer Structure 1

1st Layer (substrate layer):

0.10 g gelatine

2nd Layer (blue-sensitive layer):

blue-sensitive silver halide emulsion (99.5 mole % AgCl, 0.5 mole % AgBr, average grain diameter 0.9 μm), comprising
- 0.50 g gelatine
- 0.42 g yellow coupler GB-1
- 0.18 g yellow coupler GB-2
- 0.50 g tricresyl phosphate (TCP)
- 0.10 stabiliser ST-1

3rd Layer (intermediate layer):

1.1 g gelatine 0.06 g scavenger SC-1

0.06 g scavenger SC-2

0.12 g TCP

4th Layer (green-sensitive layer):

green-sensitive silver halide emulsion (99.5 mole % AgCl, 0.5 mole % AgBr, average grain diameter 0.47 μm), comprising
- 0.40 g $AgNO_3$
- 0.77 g gelatine
- 0.21 g magenta coupler PP-1
- 0.15 g magenta coupler PP-2
- 0.05 g magenta coupler PP-3
- 0.06 g colour stabiliser ST-2
- 0.12 g scavenger SC2
- 0.23 g dibutyl phthalate 5th Layer (UV protection layer):

1.15 g gelatine 0.03 g scavenger SC-1

0.03 g scavenger SC-2

0.5 g UV absorber UV-1

0.10 g UV absorber UV-2

0.35 g TCP

6th Layer (red-sensitive layer):

red-sensitive silver halide emulsion (99.5 mole % AgCl, 0.5 mole % AgBr, average grain diameter 0.5 μm), comprising
- 0.30 g $AgNO_3$, with
- 1.0 g gelatine
- 0.40 g cyan coupler BG-1
- 0.05 g cyan coupler BG-2
- 0.46g TCP 7th Layer (UV protection layer):

0.35 g gelatine 0.15 g UV-1

0.03 g UV-2

0.09 g TCP

8th Layer (protective layer):

0.9 g gelatine 0.3 g hardener HM 0.05 g optical brightener W-1

0.07 g vinylpyrrolidone 1.2 mg silicone oil 2.5 mg small polymethyl methacrylate spheres with an average particle diameter of 0.8 μm

GB-1

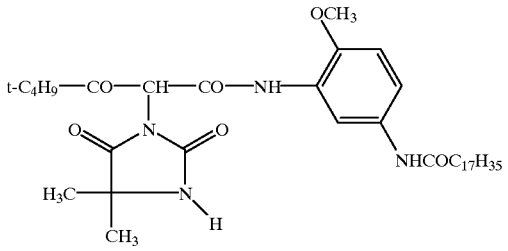

GB-2

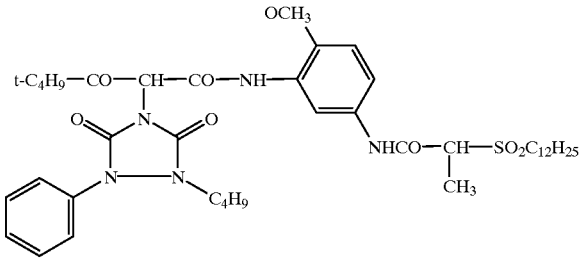

ST-1

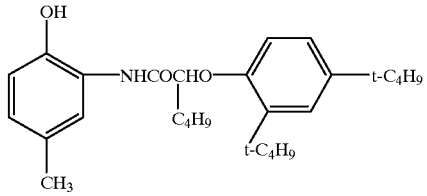

SC-1

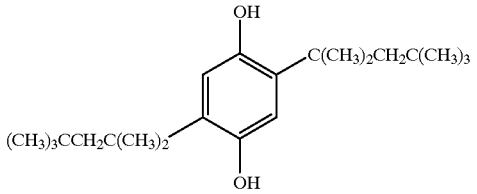

-continued
SC-2
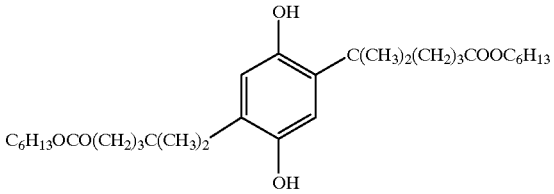
PP-1
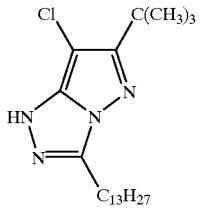
PP-2
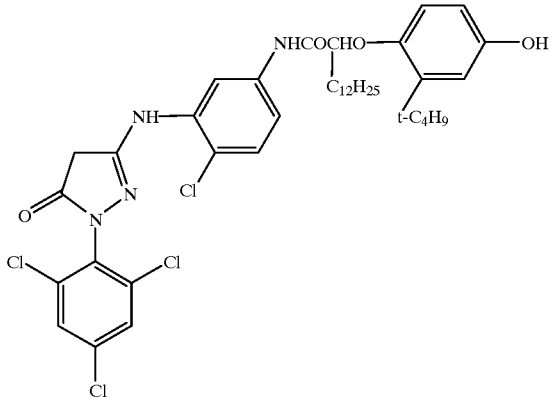
PP-3
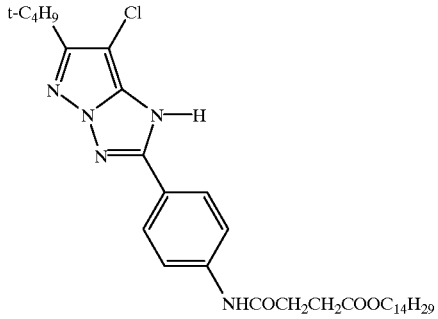
ST-2
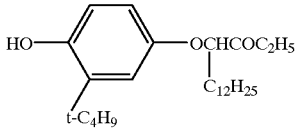
UV-1
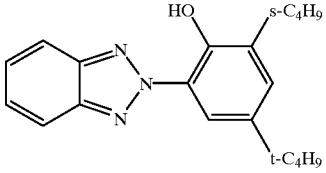
UV-2
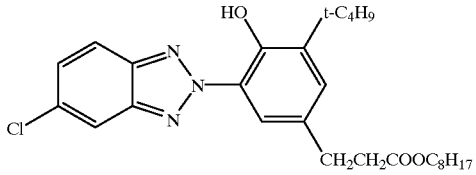
BG-1
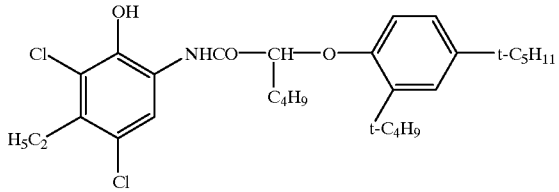
BG-2
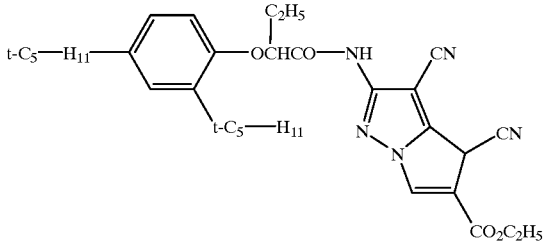
W-1
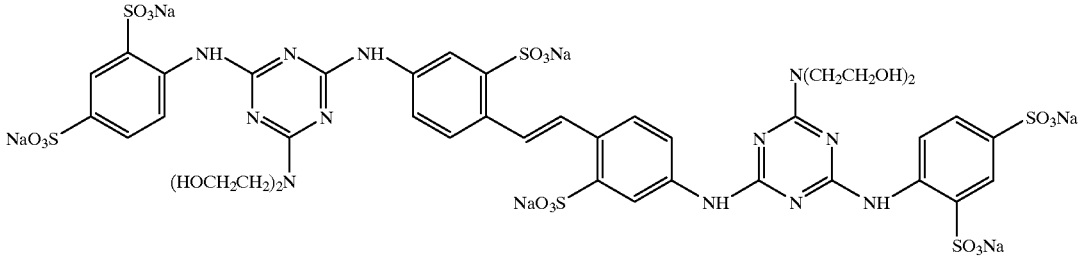

-continued

HM

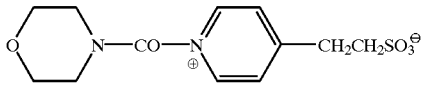

The colour photographic recording material was exposed though a step wedge. In the course of this procedure, additional filters were inserted into the beam path of the exposure device, so that the wedge appeared neutral at an optical density of D=0.6.

The material was processed under the following conditions:

| Step | Time | Temperature |
|---|---|---|
| developing | 27 seconds | 39° C. |
| bleach-fixing | 27 seconds | 35° C. |
| stabilising | 54 seconds | 33° C. |

First of all, the ready-to-use developers comprising the concentrates according to Example 5 and 13 were used as the colour developers, and then the ready-to-use developer prepared from three separate concentrates according to the prior art was used as the colour developer. Both ready-to-use developers were of the same composition.

Bleach Fixing Bath

| | |
|---|---|
| ammonium thiosulphate solution, 58% by weight, aqueous | 80 ml |
| sodium disulphite | 5 g |
| ammonium iron EDTA, 48% by weight, aqueous | 70 ml |

made up to 1000 ml with water, pH adjusted to 6.5 with ammonia or acetic acid.

Stabilising Bath

| | |
|---|---|
| water | 900 ml |
| sodium sulphite | 2 g |
| hydroxyethanediphosphonic acid, disodium salt | 4 g |
| sodium benzoate | 0.5 g |

made up to 1000 ml with water, pH adjusted to 5 with sodium hydroxide solution or acetic acid.

Drying

The images produced were identical with regard to their sensitometric quality.

EXAMPLE 23

A colour photographic recording material for colour negative colour development was produced by depositing the following layers in the given sequence on a transparent film base of cellulose triacetate. The quantitative data are given with respect to 1 $m^2$ in each case. The corresponding amounts of $AgNO_3$ are quoted for silver halide deposition. The silver halides were stabilised with 1 mmol 4-hydroxy-6-methyl-1,3,3a,7-tetraazaindene per mol $AgNO_3$. All the emulsions were chemically ripened, in the optimum manner, with sulphur, selenium and gold.

| | | |
|---|---|---|
| 1st layer | (antihalo layer) | |
| 0.3 | g | black colloidal silver |
| 1.2 | g | gelatine |
| 0.3 | g | UV absorber UV-2 |
| 0.2 | g | DOP (developer oxidation product) scavenger SC-3 |
| 0.02 | g | tricresyl phosphate (TCP) |
| 2nd Layer | (low red-sensitivity layer) | |
| 0.7 | g | $AgNO_3$ of an AgBrI emulsion which was spectrally sensitised to red, comprising 4 mol % iodide, average grain diameter 0.42 μm, AV 5, VVK 25% |
| 1 | g | gelatine |
| 0.35 | g | colourless coupler C-1 |
| 0.05 | g | coloured coupler RC-1 |
| 0.03 | g | coloured coupler YC-1 |
| 0.36 | g | TCP |
| 3rd Layer | (medium red-sensitivity layer) | |
| 0.8 | g | $AgNO_3$ of an AgBrI emulsion which was spectrally sensitised to red, comprising 5 mol % iodide, average grain diameter 0.53 μm, AV 6, VVK 23% |
| 0.6 | g | gelatine |
| 0.15 | g | colourless coupler C-2 |
| 0.03 | g | coloured coupler RC-1 |
| 0.02 | g | DIR coupler D-1 |
| 0.18 | g | TCP |
| 4th Layer | (high red-sensitivity layer) | |
| 1 | g | $AgNO_3$ of an AgBrI emulsion which was spectrally sensitised to red, comprising 6 mol % iodide, average grain diameter 0.85 μm, AV 9, VVK20% |
| 1 | g | gelatine |
| 0.1 | g | colourless coupler C-2 |
| 0.005 | g | DIR coupler D-2 |
| 0.11 | g | TCP |
| 5th Layer | (intermediate layer) | |
| 0.8 | g | gelatine |
| 0.07 | g | DOP scavenger SC-2 |
| 0.06 | g | aluminium salt of aurintricarboxylic acid |
| 6th Layer | (low green-sensitivity layer) | |
| 0.7 | g | $AgNO_3$ of an AgBrI emulsion which was spectrally sensitised to green, comprising 4 mol % iodide, average grain diameter 0.35 μm, AV 5, VVK 20% |
| 0.8 | g | gelatine |
| 0.22 | g | colourless coupler M-1 |
| 0.065 | g | coloured coupler YM-1 |
| 0.02 | g | DIR coupler D-3 |
| 0.2 | g | TCP |
| 7th Layer | (medium green-sensitivity layer) | |
| 0.9 | g | $AgNO_3$ of an AgBrI emulsion which was spectrally sensitised to green, comprising 4 mol % iodide, average grain diameter 0.50 μm, AV 7, VVK 24% |
| 1 | g | gelatine |
| 0.16 | g | colourless coupler M-1 |
| 0.04 | g | coloured coupler YM-1 |
| 0.015 | g | DIR coupler D-4 |
| 0.14 | g | TCP |
| 8th Layer | (high green-sensitivity layer) | |
| 0.6 | g | $AgNO_3$ of an AgBrI emulsion which was spectrally sensitised to green, comprising 6 mol % iodide, average grain diameter 0.70 μm, AV 10, VVK 20% |
| 1.1 | g | gelatine |
| 0.05 | g | colourless coupler M-2 |
| 0.01 | g | coloured coupler YM-2 |
| 0.02 | g | DIR coupler D-5 |
| 0.08 | g | TCP |
| 9th Layer | (yellow filter layer) | |
| 0.09 | g | yellow dye GF-I |
| 1 | g | gelatine |
| 0.08 | g | DOP scavenger SC-2 |

-continued

| | | |
|---|---|---|
| 0.26 | g | TCP |
| 10th Layer (low blue-sensitivity layer) | | |
| 0.3 | g | $AgNO_3$ of an AgBrI emulsion which was spectrally sensitised to blue, comprising 6 mol % iodide, average grain diameter 0.44 μm, AV 4, VVK 20% |
| 0.5 | g | $AgNO_3$ of an AgBrI emulsion which was spectrally sensitised to blue, comprising 6 mol % iodide, average grain diameter 0.5 μm, AV 5, VVK 18% |
| 1.9 | g | gelatine |
| 1.1 | g | colourless coupler Y-1 |
| 0.037 | g | DIR coupler D-6 |
| 0.6 | g | TCP |
| 11th Layer (high blue-sensitivity layer) | | |
| 0.6 | g | $AgNO_3$ of an AgBrI emulsion which was spectrally sensitised to blue, comprising 7 mol % iodide, average grain diameter 0.95 μm |
| 1.2 | g | gelatine |
| 0.1 | g | colourless coupler Y-1 |
| 0.006 | g | DIR coupler D-7 |

-continued

| | | |
|---|---|---|
| 0.11 | g | TCP |
| 12th Layer (micrate layer) | | |
| 0.1 | g | $AgNO_3$ of a micrate-AgBrI emulsion, comprising 0.5 mol % iodide, average grain diameter 0.06 μm |
| 1 | g | gelatine |
| 0.004 | mg | $K_2[PdCl_4]$ |
| 0.4 | g | UV absorber UV-3 |
| 0.3 | g | TCP |
| 13th Layer (Protective and hardener layer) | | |
| 0.25 | g | gelatine |
| 0.75 | g | hardener HM |

The overall layer structure exhibited a swelling factor 3.5 after hardening.

Substances used in Example 23 which are not described in Example 22:

UV-3

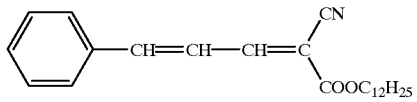

C-1

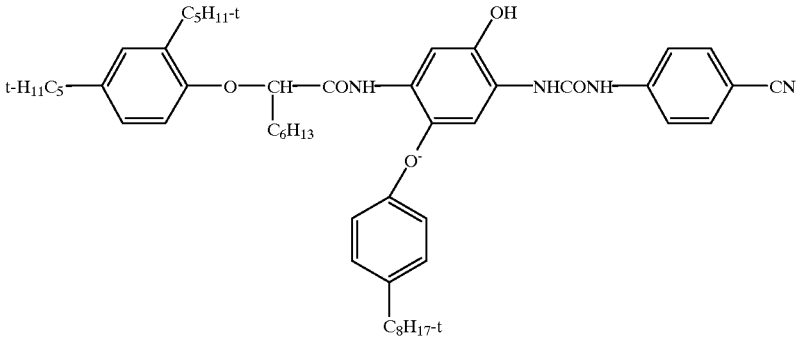

C-2

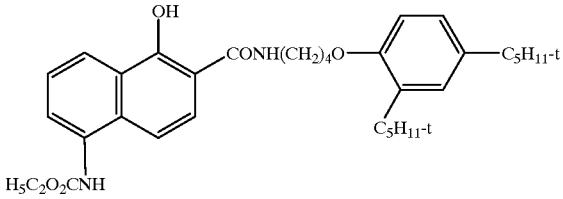

RC-1

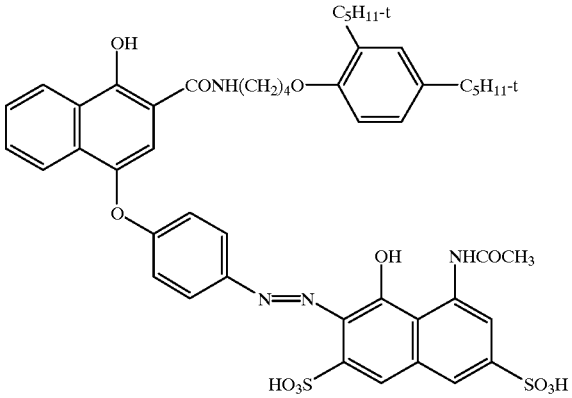

-continued
YC-1
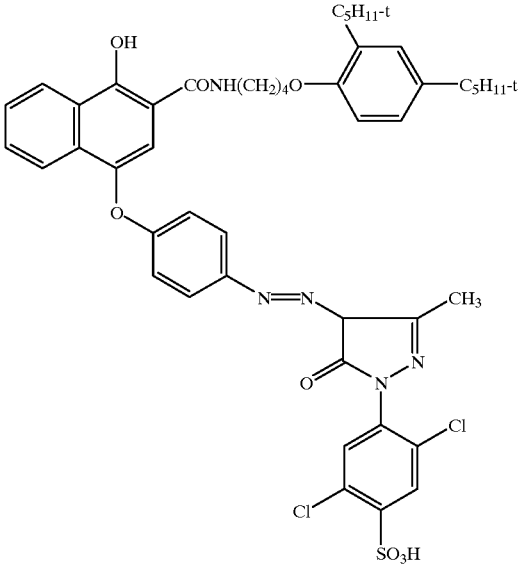
M-1
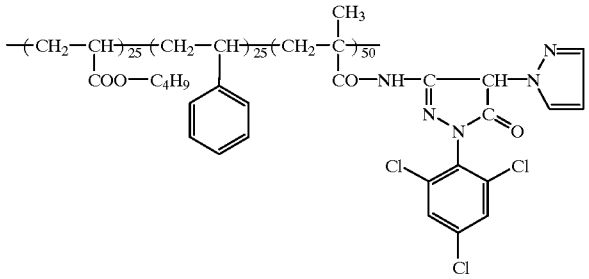
M-2
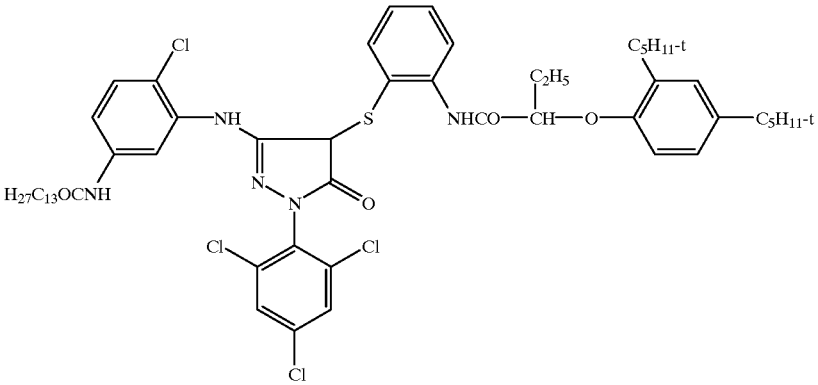
YM-1
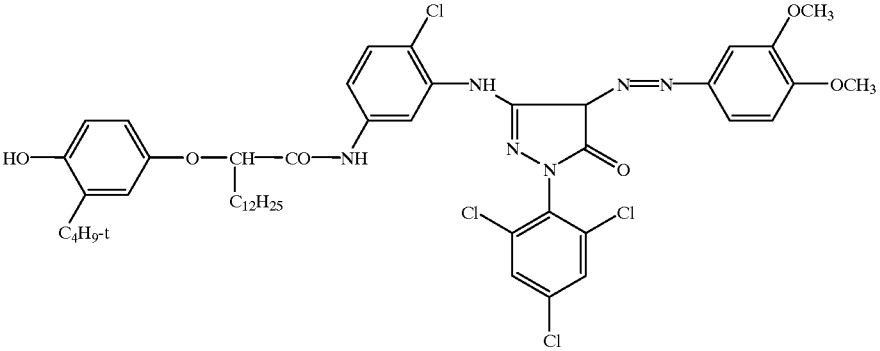

-continued
YM-2
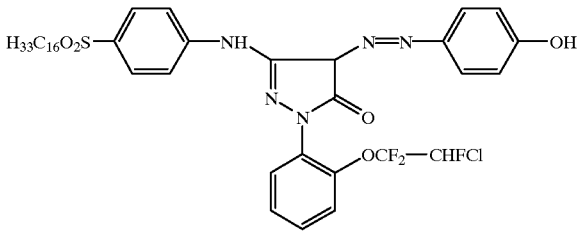
Y-1
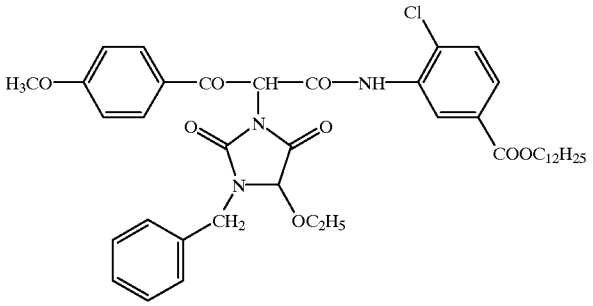
D-1
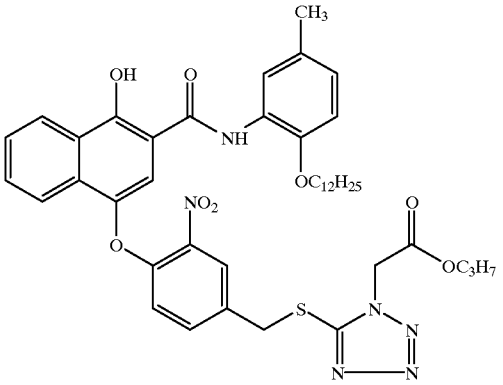
D-2
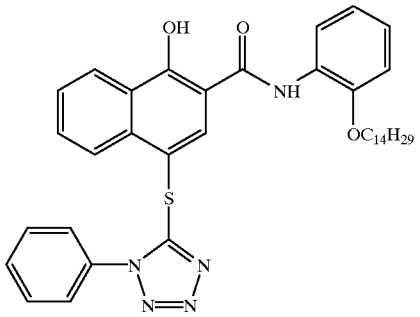
D-3
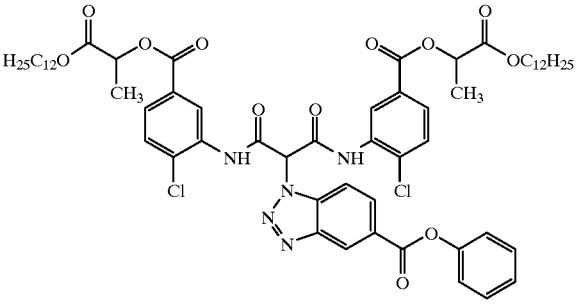
D-4
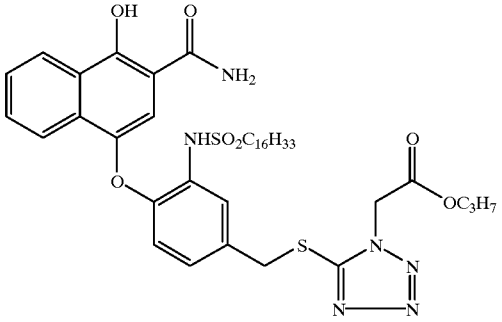
D-5
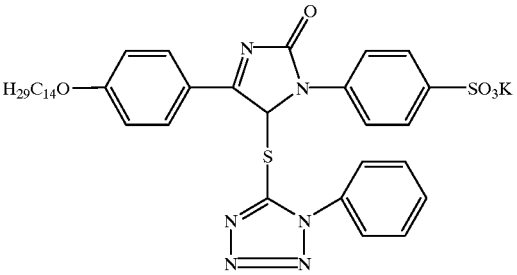
D-6
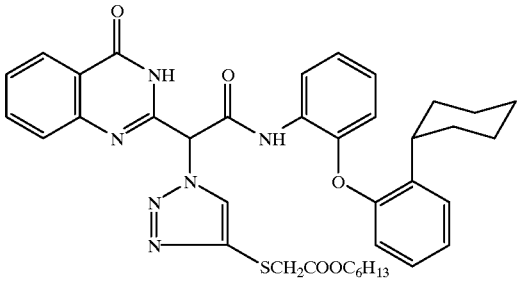
D-7
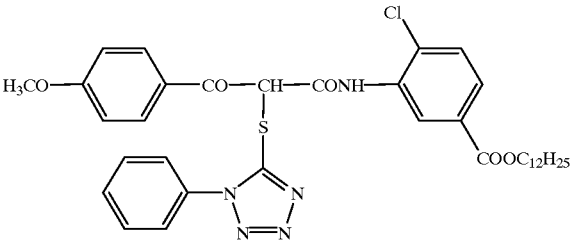
SC-3
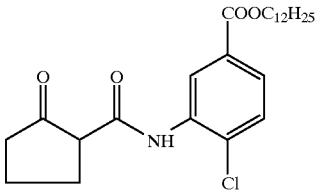

-continued

GF-1

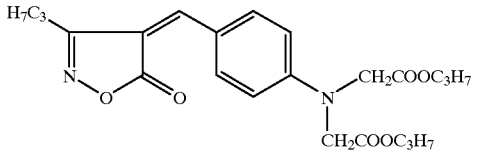

After exposure through a neutral wedge filter, development was effected according to The British Journal of Photography, 1974, pages 597 and 598. In the course of this procedure, a developer solution was first of all used which was prepared from the one-part concentrate according to Example 17 and secondly a developer solution was used which was prepared from three separate concentrates according to the prior art.

The colour negatives obtained were identical as regards their sensitometric quality.

What is claimed is:

1. A one-part color developer concentrate which comprises at least two phases and which is free from precipitates at 20° C., which contains at least one color developer substance, at least one antioxidant, at least one anti-lime agent, a buffer system and alkali has a pH of at least 9 and a concentration of cations from 0.5 to 15 mol/l, wherein at least 10 mol % of the cations are sodium ions and contains at least 50 mmol color developer substance per liter.

2. A one-part color developer concentrate according to claim 1, wherein the sodium ion content is at least 30 mol %.

3. A one-part color developer concentrate according to claim 1, wherein the sodium ion content is at least 50 mol %.

4. A one-part color developer concentrate according to claim 1, wherein the organic solvent is caprolactam.

5. A one-part color developer concentrate according to claim 1, wherein the color developer substance is 4-(N-ethyl-N-2-methylsulphonylaminoethyl)-2-methyl-phenylenediamine sequisulphate or 4-(N-ethyl-N-2-hydroxyethyl)-2-methyl-phenylenediamine sulfate.

6. A one-part color developer concentrate according to claim 1, wherein at least one of the phases is an organic phase and one is an aqueous phase, the organic phase containing one or more water-soluble organic solvents, wherein 50 to 95% by weight of the sum of organic solvents and water are water.

7. The one-part color developer concentrate as claimed in claim 6, wherein 60 to 90% by weight of the sum of organic solvents and water are water.

8. The one-part color developer concentrate as claimed in claim 6, wherein said water-soluble solvents are urea, alcohols, ketones, carboxylic acid esters, phosphonic acid esters, aldehydes, oximes or amines.

* * * * *